US007249766B1

(12) United States Patent
Kennedy

(10) Patent No.: US 7,249,766 B1
(45) Date of Patent: Jul. 31, 2007

(54) QUOIT BOARD

(76) Inventor: Nicholas A. Kennedy, 1155 Stone Crossing Rd., Easton, PA (US) 18045

( * ) Notice: Subject to any disclaimer, the term of this patent is extended or adjusted under 35 U.S.C. 154(b) by 0 days.

(21) Appl. No.: 11/242,097

(22) Filed: Oct. 3, 2005

Related U.S. Application Data

(60) Provisional application No. 60/644,692, filed on Jan. 18, 2005.

(51) Int. Cl.
*A63B 67/06* (2006.01)

(52) U.S. Cl. ..... 273/336; 273/348

(58) Field of Classification Search ..... 273/336, 273/338, 398, 400, 348; D21/300–304
See application file for complete search history.

(56) References Cited

U.S. PATENT DOCUMENTS

| | | | | |
|---|---|---|---|---|
| 324,189 | A | 8/1885 | Thomas | |
| 1,178,049 | A | 4/1916 | Beardsley | |
| 1,541,897 | A * | 6/1925 | Buedingen | 273/336 |
| 2,504,570 | A * | 4/1950 | Neilson | 273/336 |
| 4,045,028 | A | 8/1977 | Dyess | |
| 5,620,185 | A | 4/1997 | Robertson | |
| 6,135,455 | A | 10/2000 | McNally | |
| 2006/0108741 | A1 * | 5/2006 | Whiteside | 273/336 |

* cited by examiner

*Primary Examiner*—Raleigh W. Chiu
(74) *Attorney, Agent, or Firm*—Charles A. Wilkinson; Clinton H. Wilkinson

(57) ABSTRACT

A quoit board and method of manufacture of a quoit board that is significantly lighter than a conventional slate quoit board, the board portion of which is made from a plastic material and wherein the surface of the plastic is treated to provide a suitable playing surface for receiving rubber quoits tossed at such surface during play.

14 Claims, 3 Drawing Sheets

QUOIT BOARD

CROSS-REFERENCE TO PREVIOUS RELATED APPLICATION

This invention claims priority from U.S. Provisional Patent Application Ser. No. 60/644,692, filed on Jan. 18, 2005, the complete disclosure of which is incorporated herein by reference.

BACKGROUND OF THE INVENTION

1. Field of the Invention

The present invention relates generally to games of toss wherein a projectile is tossed at a target, and more particularly to the game of quoits, and even more particularly to an improved quoit board or game target.

2. Preliminary Discussion

The game of quoits is a centuries old game that was brought to the Americas during colonial times. The earliest forms of the game were similar to the present game of horseshoes, but where players take turns throwing metal rings at a stake about 20 feet away. While the game of horseshoes has continued to thrive in the U.S., the original metal ring version of quoits has basically disappeared in most of the United States. Quoits, however, remains popular in the eastern United States, particularly in central and eastern Pennsylvania and New Jersey, in several modified versions. In the most popular modified version, which has been played in Pennsylvania for at least 120 years, the metal rings have been replaced with rings made of hard rubber, and the stakes in the ground have been replaced with two-foot square slate boards which are about 1¼ inches thick (after running through a grinding machine) and have an aluminum or metal hub or peg secured therein protruding upwardly from the center top of the board. A quoit board support usually made of wood is attached to the underside of the rearward edge of the board extending downwardly such that when the board is placed on the ground, the top or playing face is slanted or angled downwardly towards the players. Scoring rings are then usually provided on the face of the board surrounding the peg. During play, two boards are set up facing each other about 18 ft. apart, and the players take turns tossing the rubber rings at the target and stake on the board. A cumulative scoring system based on the accuracy or results of the tosses is used to determine the winning player or team.

The version of the game quoits just described became popular in eastern Pennsylvania and New Jersey because such area is the heart of the so-called "slate belt" of the United States, where large quantities of high quality slate from which the quoit boards can be manufactured are readily available. Slate is a hard rock that naturally breaks into thin, smooth layers, and has a composition and structure that enables it to be cut into square pieces and then sanded to the proper texture fairly easily as compared with most other known natural or man-made materials. Slate quoit boards have also been popular because slate has a consistency which when impacted by a hard rubber quoit deadens the impact, provides a characteristic thump when thrown properly, which is familiar and soothing to regular quoit players, and has a surface friction which retards sliding of the quoits down the slanted surface of the board. Unfortunately, however, quoits has not significantly increased in popularity outside of this general area, and in fact remains relatively unknown in many parts of the United States as well as in most of the rest of the world. A major reason for such only regional popularity of the game of quoits is that it is prohibitively expensive to transport or ship pairs of slate quoit boards each weighing approximately 66 lbs. even relatively short distances, so that only local delivery and pickup services for the boards is usually available. In addition, while slate has properties that make it ideal for use in making quoit boards, a drawback of slate is that it chips rather easily, so that greater than normal care in packaging and transporting the boards is required, further increasing the shipping costs. Nevertheless, judging from the popularity of quoits in the "slate belt" and closely surrounding areas, and from the popularity of horseshoes in general throughout the United States and world, the present inventor believes that if made readily available and properly marketed, quoits would quickly expand in popularity. Recognizing such opportunity, the present inventor, after much experimentation and research, has now developed a quoit board that rather than being made from slate is made of a lighter and more durable plastic material, weighing less than 25 lbs. Through a unique manufacturing process and method, a quoit board having most of the advantages of slate quoit boards but also being light enough to ship or delivery at a reasonable cost has resulted. It is believed that through use of such board the popularity of quoits will quickly spread into areas where it is currently relatively unknown.

3. Description of Related Art

As indicated above, quoits boards made of slate are well known, particularly in the northeast United States, and more specifically in eastern Pennsylvania and New Jersey. Slate is used as the game board not only because it is readily available in such area, but also because the playing surface can be sanded to provide the proper texture. If the playing surface is too smooth, the rubber quoits will slide off the board too easily when thrown at the target. On the other hand, if the surface is too rough, the rubber quoits will be quickly become worn or damaged as they are thrown and come into contact with the playing surface. While other materials such as wood and cement have been used as quoit boards, none have proved to be satisfactory, as such other materials are either too hard or soft, or the surface too slippery or on the other hand too abrasive, to be used effectively. Therefore, up to now most of the advances in such game have been with respect to methods of playing, rather than in the game board itself. There are many other types and variations of games known in the prior art where projectiles are thrown or tossed at a target. For example, in U.S. Pat. No. 4,565,375 issued to D. Dresel entitled "Game Apparatus", a rectilinear shaped device having a centrally disposed receptacle in its upper surface that opens to the inside of the device, and further having a backstop device extending upwardly from the rear side of the receptacle. Quoit-like discs are then tossed at the device, with the aim being to direct them into the receptacle. While such new devices provide new games and the like that are useful for their particular purposes, as far as the present inventor is aware, no one has previously been able to develop a quoit board that can satisfactorily simulate the experience of playing quoits with a slate quoit board but which board is lighter and more durable than such slate boards, and which objective is accomplished by the present inventor's boards.

OBJECTS OF THE INVENTION

It is therefore a primary object of the present invention to provide a quoit board incorporating the advantages of conventional slate quoit boards during play but that is more durable and less costly to manufacture than slate quoit boards.

It is a still further object of the invention to provide a process of making an improved quoit board from a material other than slate wherein the target or playing surface of the board is textured so that it is neither too smooth for the quoits to properly adhere to the board nor too coarse for the quoits to be damaged when contacting such surface.

It is a further object of the invention to manufacture quoit boards from High Density Polyethylene (HDPE) plastic.

It is a still further object of the invention to provide a quoit board that weighs significantly less than a slate quoit board, thereby significantly reducing the shipping costs associated with such boards, but that also has most of the advantages of such slate quoit boards.

Still other objects and advantages of the invention will become clear upon review of the following detailed description in conjunction with the appended drawings.

SUMMARY OF THE INVENTION

The invention is directed to an improved quoit board construction for use during play of the game of quoits and a method of manufacture. In the past, quoit boards have been almost without exception made of slate, which due to its significant weight made the cost of shipping such boards prohibitively expensive and limited the potential market for such boards to the "slate belt" area. While previous attempts to manufacture quoit boards using other materials have proved unsatisfactory, the present inventor has developed a quoit board that is made preferably from a sheet of high density polyethylene (HDPE), one surface of which sheet is treated so that it has satisfactory coarseness for use as a quoit board playing surface. Such boards are of a low weight in comparison to slate quoit boards, but include most if not all of their desirable characteristics. It is believed that the use of such low-weight boards will substantially expand the popularity of the game outside of current areas.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

While quoits is widely known and popular in the "slate belt" area of the United States in Pennsylvania and New Jersey, where some high schools have quoit teams that compete with teams from rival high schools, such game has not gained popularity to any substantial degree in other areas, primarily due to the natural barriers created by the sheer weight of each slate quoit board. While there have been of course those persons who have moved from the eastern Pennsylvania and New Jersey areas to other areas of the county and who have brought their slate quoit boards with them, in general slate boards are not often shipped either by ground or air transport since the weight of the boards makes such shipping costs prohibitively high for the average person to justify on top of the cost of the boards themselves, which are not inexpensive. The present inventor has identified as a result the need for a lower weight slate board that includes most if not all of the desirable characteristics of traditional slate boards that is relatively simple and inexpensive to manufacture but that does not have the substantial weight of a slate board and therefore is easier and less expensive to transport or ship. Through trial and error and a significant investment of time and experimentation, the present inventor has developed a process for manufacturing a quoit board that is made preferably of high density polyethylene (HDPE) having a substantially lower weight than a similarly sized slate quoit board. Such material must be treated on one surface, which surface will form the playing surface, so that it has the proper coarseness or frictional properties that will cause a rubber quoit that is tossed at the board during play not to slip off of the board so easily so as to make the game board inoperative, but will also not be so coarse or rough that the rubber surface of the quoit will be damaged upon repeated impacts with such playing surface. The present inventor has found that this can be accomplished by subjecting the playing surface to a sandblasting process for a predetermined period of time using a fine grit material. In addition, scoring markings may be provided in the playing surface to facilitate calculation of the scores of playing based on the accuracy of their tosses. Such game boards will substantially increase the market that is available for such game from a practicability standpoint, and therefore its overall popularity.

Figure 1:
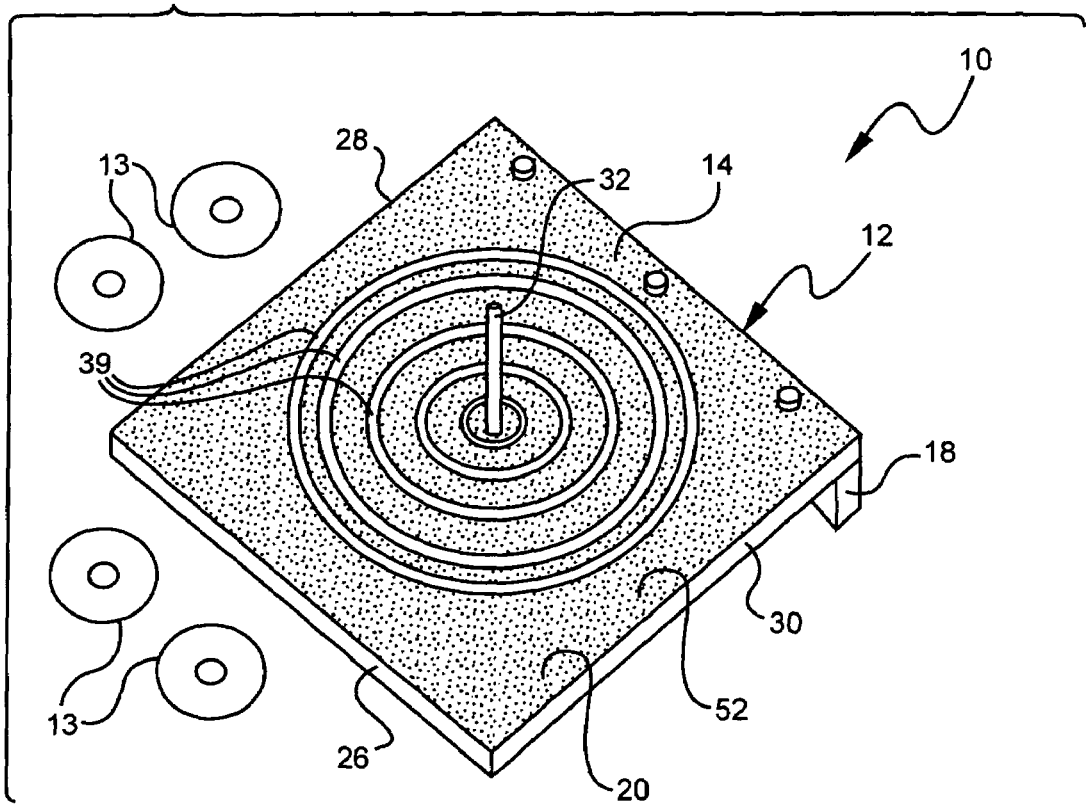
FIG. 1 is a perspective view of a quoit board manufactured according to the process and method of the present invention.
Figure 2:
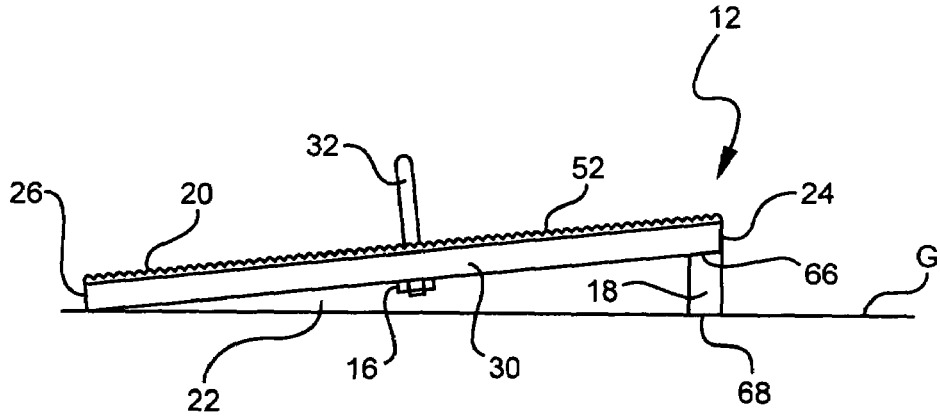
FIG. 2 is a side view of the quoit board of the present invention.

FIGS. 1 and 2 illustrate a quoit set 10 including quoit board 12 (of which there are two in a typical set, but only one of which is shown in FIG. 1), and several rubber quoits 13. Quoit board 12 is generally comprised of a board section 14, a hub 16, and a quoit board support 18. Board section 14 is generally square in shape and has a top surface 20 that serves as the playing surface for board 12, a bottom surface or underside 22, a rear edge 24, a forward edge 26, and side edges 28 and 30. Hub 16, shown in more detail in FIG. 6, includes peg 32 which is preferably made of brass or aluminum and is arranged so as to extend upwardly from the center of top surface 20 of board section 14. Quoit board support 18 is secured extending downwardly from the underside 22 of board section 14 along rear edge 24, such that the playing surface 20 of board 12 is disposed or slanted forwardly toward the players. Equally spaced apart scoring rings 39 are also provided in the top surface 20 of board section 14, with the process for providing such scoring rings being described in further detail below. While all prior art quoit boards, so far as the present inventor is aware, are made of slate, and in some sporadic cases plywood or cement, the present inventor has conceived of a process and method for manufacturing quoit boards 12 such as shown in FIGS. 1 and 2 from a hard plastic material, preferably polyethylene, polypropylene, or polyurethane, and most preferably from High-Density Polyethylene (HDPE) having a thickness of one inch, and the density of which may vary. HDPE is normally manufactured in sheet form, with sheets having a thickness of one inch being one of several stock sizes of such sheets that are normally routinely commercially available from various sources, which sheets are therefore less expensive than if sheets having a custom thickness or density were required. A substantial cost savings in the manufacturing process of quoit boards 12 therefore results through the use of such stock sized sheets.

Figure 3:
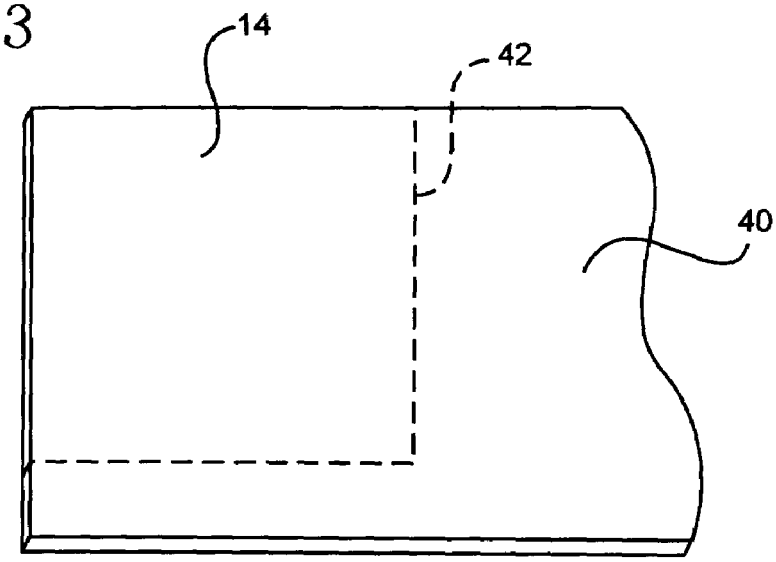
FIG. 3 illustrates a portion of a sheet of polyethylene material as it would be cut to form a quoit board according to the process and method of the present invention.
Figure 4:
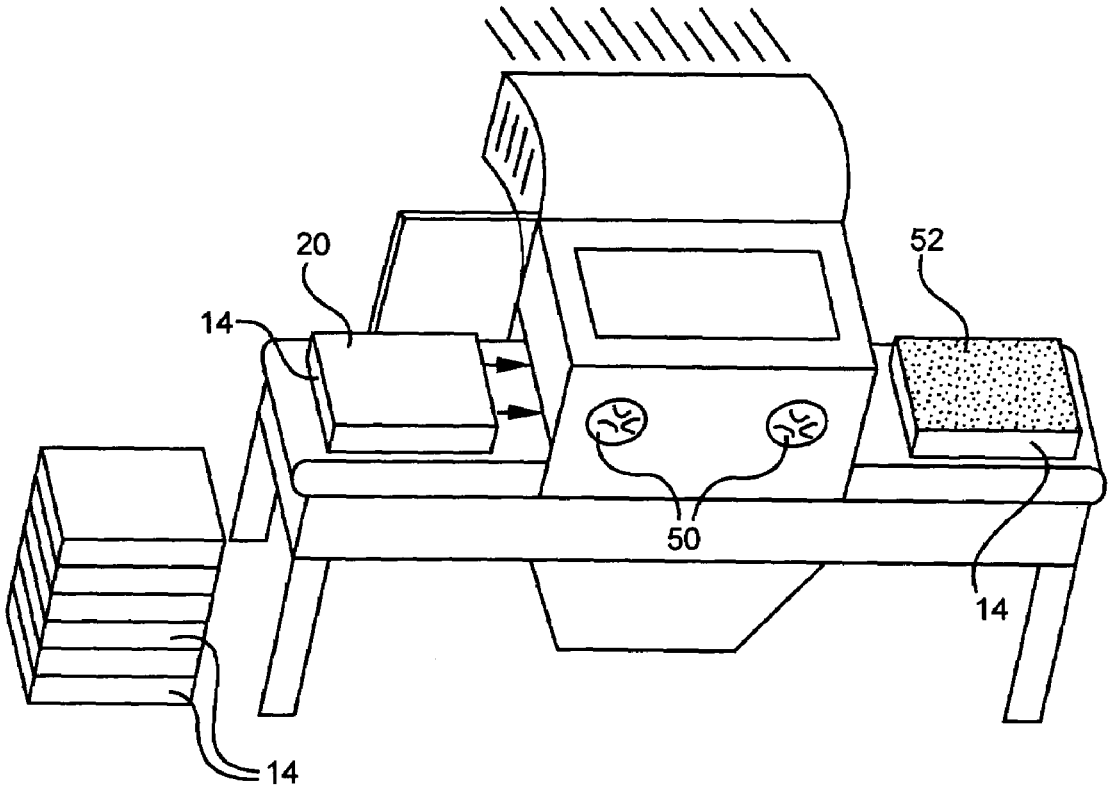
FIG. 4 illustrates steps in a process for treating the playing surface of a prospective HDPE quoit board to provide an appropriate texture.
Figure 5:
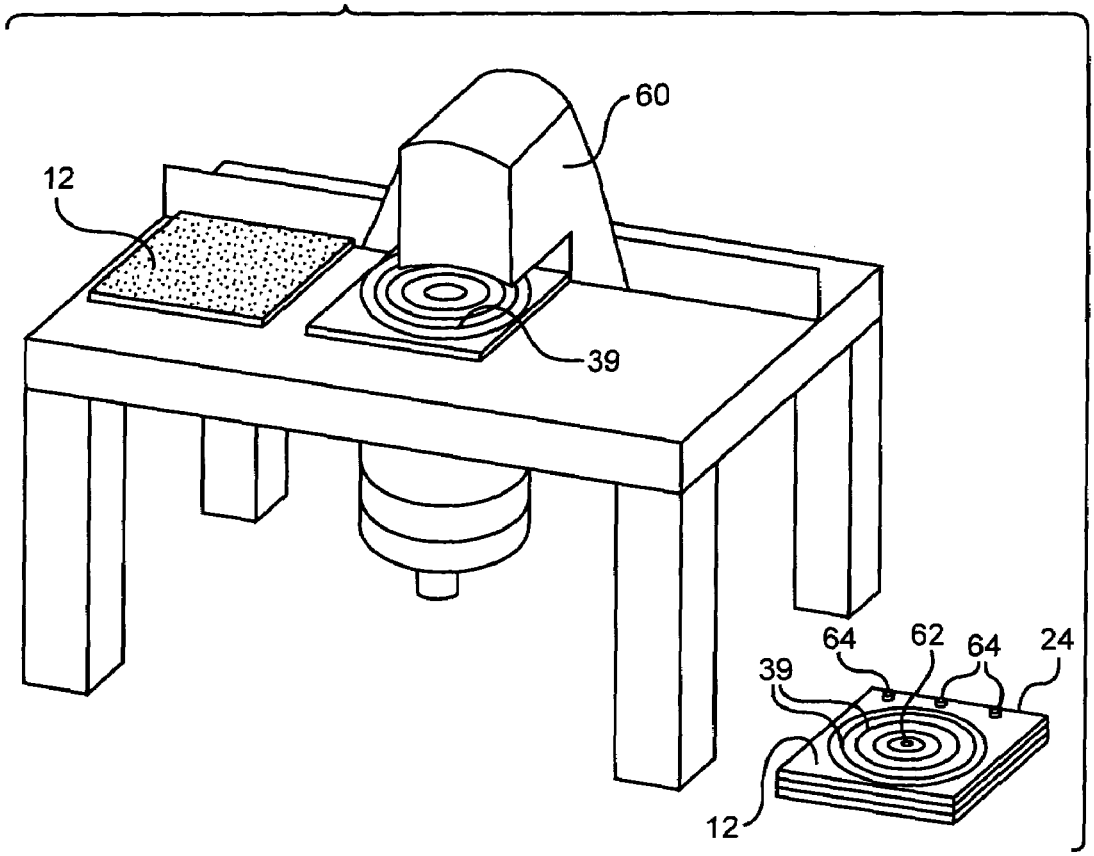
FIG. 5 illustrates the formation or marking of the playing surface of a quoit board in accordance with the invention with appropriately spaced-apart scoring rings.

FIGS. 3–5 illustrate a preferred method of manufacturing board sections 14 of quoit boards 12 according to the teachings of the present invention. Where indicated, such steps may be in a different order without deviating from the nature and scope of the invention. As indicated above, board sections 14 are preferably made of high-density polyethylene (HDPE) material, which material is commercially available in stock sized sheets, one of which sheets 40 is shown in a partial view in FIG. 3. A typical HDPE sheet may be 4 feet by eight feet. At least one, and preferably several, boards 14 are cut (as illustrated by dotted line 42 in FIG. 3) if possible from each sheet 40 in 2 ft. by 2 ft. squares, the standard dimensions for a quoit board playing surface, and with the boards preferably having, as indicated above, a thickness of one inch. While suitable for some purposes, the stock HDPE sheet material, however, without further treatment of the top surface 20, is not suitable for use as the playing surface for a quoit board because such top surface is too smooth or slick to hold a rubber quoit tossed or projected at such surface, effectively making the game too difficult to be played. Thus, the coarseness or roughness of one side surface of the HDPE sheet must be increased to within a certain range prior to its use as a quoit game board playing surface. Although various methods are available which could be used to treat the quoit game board playing surface to increase its roughness or coarseness, such as with a blasting abrasive in a blast cabinet, the preferred method for doing so is by sandblasting.

FIG. 4 illustrates several board sections 14 that have been cut into 2 ft. by 2 ft. squares from a sheet or sheets of HDPE material and are being fed or placed in a sandblast machine 50, where the top surface 20 of each board section 14 is subjected to sandblasting. While the specifics of sandblast machine 50 are not shown, such machines are well known in the prior art and may be either manually operated or computer operated. A suitable machine is the Flip Top sandblast machine manufactured by Econoline Abrasive Products headquartered in Grand Haven, Mich. Sandblasting should continue at least until the entire top surface of the board sections has been treated and has a uniform coarseness, which is illustrated or depicted in the Figures by stippled markings 52 on top surface 20 of such treated board sections after they have been passed through sandblast machine 50. See also FIGS. 1 and 2. The present inventor has found that use of a fine sand grit or abrasive, such as the fine coal slag abrasive sold by Reed Minerals of Camp Hill, Pa. under the trademark Black Beauty®, for finishing the playing surfaces by sandblasting or profiling, at a range of about 1.5 feet, is most preferred, as it results in a playing surface which when quoits 13 are tossed at the board during actual play is neither so slick or smooth that the quoits slide off the board too easily, nor so rough or coarse that the quoits are nicked or damaged upon impact with the board. After a board has been subjected to sandblasting, the treated top surface should now be suitable for use as a quoit board playing surface utilizing conventional stiff rubber quoits 13 weighing approximately one pound each. Other sand grits or abrasives could also be used and may, of course, vary slightly, depending on the hardness of the rubber used in manufacturing the quoits, or even the desired difficulty of the game. For example, a finer grit could be used to provide a slightly smoother playing surface, which would make it more difficult to maintain a tossed quoit on the playing surface, or a coarser grit could be used to provide a slightly rougher than average playing surface, which would tend to cause such quoits to stick to or remain on the playing surface upon impact with the board. Of course, in either case, a quoit that is over the hub or peg will remain on the board. Another advantage of using HDPE in manufacturing the quoit boards is that the sandblasting procedure is quicker and easier than in manufacturing slate boards, since with slate boards the slate is typically grinded from a piece that is two inches thick to a piece that is one inch thick, which piece is then sandblasted to give it the desired finish. Thus, by using HDPE sheets having a stock thickness, substantial labor in manufacturing the boards is eliminated. On the whole, the plastic boards have a rougher texture after sandblasting treatment than the slate boards, which have a smoother feel after sandblasting.

After the top surface 20 of the board section 14 has been treated by sandblasting, scoring rings 39 must be etched or scoured into top surface 20. This is preferably accomplished using a router 60, as illustrated generally in FIG. 5. Such tools or machines are of course well known in the prior art, and the routing process can be performed using a simple manually operated router or automatically via an industrial router system. In one arrangement, for example, a router made by Ryobi, Model R161KT is used, in combination with an attachment that enables the router to be moved across the playing surface of board section 14 in a circular motion to make each of the scoring rings quickly and easily. First, hole 62 is drilled through the center of each board section 14 for attaching hub 32. The router attachment is simply an elongated bar having several holes spaced apart along the length of the bar, and having a means for connecting the bar to a router on its outer end. The attachment bar is then secured to the quoit board 12 by a bolt extending through hole 62 and the first hole in the bar, so that the router is secured to the board at the desired distance from hole 62, after which the router is moved in a circular motion to make the scoring ring. The attachment bar is then detached from the quoit board and is again secured to the board in the same manner, only this time through the second hole in the attachment bar, and the scoring ring etched in the surface of the board. Such process is repeated until all five scoring rings have been etched into the playing surface of the board. At substantially the same time as hole 62 is drilled, or at a different time if desired, holes 64 may be drilled in board section 14 spaced apart along the rear edge 24 of the board. Such holes are used for attaching board support 38 to the underside 22 of board section 14. Scoring rings 39 and holes 62 and 64 may be drilled or scoured into board section 14 prior to sandblasting the top surface 20 of the boards, which, it is believed, at least in some circumstances might smooth out any rough edges resulting from the etching and drilling processes. It is important that the top surface 20 of board sections 14 have a uniform surface texture so that when the quoits 13 are tossed at and land on the boards, there will be no rough or uneven edges or the like that will effect the movements of the quoits and therefore possibly disrupt the game. Normally, however, using the above-described process the surface is sufficiently even or uniform so that the order of sandblasting and then scouring is appropriate.

Figure 6:
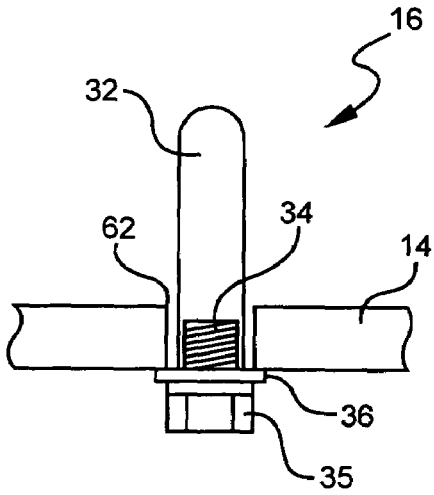
FIG. 6 is a side view of the hub or central post of a quoit board in accordance with the present invention.

After board section 14 has been treated as described above, hub 16 is secured to the playing board. Hub 16, shown in more detail in FIG. 6, is comprised of peg 32 which peg has a diameter just slightly smaller than hole 62, and has a threaded aperture 34 in its lower end. After peg 32 is inserted into hole 62, bolt 35 with washers 36 is tightened in threaded aperture 34, securing peg 32 to board section 14 as shown. Hubs of the type shown are well known in the prior art and are currently used with conventional slate quoit boards. After hub 16 has been secured to board section 14, board support 18 is also secured extending along the rear edge 24 of the underside 22 of board section 14 by screws, bolts, or the like extending downwardly through holes 64. As shown in FIG. 2, the upper edge 66 of board support 18 is cut at an angle so that it fits snugly against the underside 22 of board section 14 while its lower end 68 is flush with the ground surface G during use. This enables the quoit board to rest on the ground with the bottom edge of the board support flush with the ground surface, and ensures that the board is at the desired 60 degree angle during play.

The quoit board resulting from the process just described has several advantages over other known boards, and in addition retains the desirable characteristics of slate boards while eliminating their undesirable characteristics. Significantly, using HDPE material, a substantial portion of the weight of the slate boards has been removed or eliminated, to the point where it is now cost effective to ship such boards, whereas it is not cost effective to ship slate quoit boards. The choice of HDPE as the material is also important, as the surfaces of such material can be easily and simply treated such as by a sandblast machine to adjust the coarseness or roughness of the playing surface, which the present inventor discovered through trial and error and testing of other possible materials. While any color of HDPE can be used, it is preferred to use black or slate gray colored HDPE, the color being attained by use of any suitable coloring agent for the plastic during formulation.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A method of making a quoit board comprising the steps of:

providing a supply of high density plastic sheet material;

cutting the sheet material into at least one separate square section, where the square section has a dimension of about 24 inches by 24 inches, a front section, rear section, and two side sections, and weighing about 25 pounds;

treating at least one side of said square section with an abrasive slag so that the surface has an appropriate coarseness and providing a plurality of spaced apart concentric scoring rings on said surface, resulting in a quoit board playing surface having frictional slide properties causing rubber quoits tossed at said board to react in approximately the same manner as with a slate board weighing about 65–70 pounds and compensating for the differences in composition and weight between saod slate and high density plastic boards;

securing a hub extending upwardly from the center of the quoit board playing surface; and securing a board support extending downwardly from the bottom front edge of the board.

2. The method of making a quoit board of claim 1 wherein the plastic sheet material specifically selected is polyethylene having a thickness of approximately one inch.

3. The method of making a quoit board of claim 2 wherein said polyethylene sheet selected is high density polyethylene (HDPE).

4. The method of making a quoit board of claim 1 wherein the quoit board playing surface is provided with a proper coarseness by sandblasting said surface.

5. The method of making a quoit board of claim 4 wherein the grit of the sand used in sandblasting the playing surface is a fine grit.

6. The method of making a quoit board of claim 1 wherein said hub is secured in an aperture in the center of the board.

7. A method of making a quoit board comprising the steps of:

providing a supply of plastic sheet material;

cutting the sheet material into separate board sections each having a top surface and a bottom surface and a dimension of about 24 inches by 24 inches;

treating the top surface of said board section to give it the proper frictional characteristics necessary for satisfactory use as a quoit board playing surface for a board section having a particular weight and density, whereby said playing surface is sandblasted using a slag derived abrasive;

drilling a center hole in said board section;

securing a router with an appropriate bit to a router attachment bar, rotatably securing said attachment bar in said center hole, and operating said router at a distance from the center hole equal to a desired distance from the center to define the outer limit of a scoring area to mill a concentric scoring ring in the top surface of said board section;

repositioning said attachment bar and milling additional concentric scoring rings in said top surface of the board section at predetermined distances from the center hole and from each other;

removing said attachment bar and securing a hub assembly to said board section extending upwardly through said center hole; and securing a board support extending downwardly from the bottom surface of the board.

8. The method of making a quoit board of claim 7 wherein the plastic sheet material specifically provided is polyethylene having a thickness of approximately one inch.

9. The method of making a quoit board of claim 8 wherein said polyethylene sheet selected is high density polyethylene (HDPE).

10. The method of making a quoit board of claim 7 whereby said board support is secured by bolts secured in apertures in said quoit board.

11. The method of making a quoit board of claim 7 whereby said board support is arranged to support the quoit board at an angle of approximately 15 to 20 degrees with horizontal.

12. A quoit board simulating as close as practical the characteristics of a slate quoit board without the weight of slate comprising:

a. a high density polymer block having a grit blasted surface formed by a fine grit, a weight of about twenty-five pounds and a height of approximately one to one and a half inches;

b. an orifice in the center of the polymer block adapted to receive a hub extending above the surface;

c. a series of concentric engraved scoring rings in the surface of said polymer block surrounding the hub forming a simulated bullseye about the hub position, and d. a support at one side of the polymer block supporting it at an angle of approximately 15 to 20 degrees with horizontal.

13. A quoit board in accordance with claim 12 wherein the plastic composition is slate gray in color.

14. A quoit board in accordance with claim 12 wherein the plastic composition is black.

* * * * *